US010837657B2

(12) United States Patent
Furukubo et al.

(10) Patent No.: US 10,837,657 B2
(45) Date of Patent: Nov. 17, 2020

(54) OUTDOOR UNIT FOR AIR-CONDITIONING APPARATUS

(71) Applicant: Mitsubishi Electric Corporation, Tokyo (JP)

(72) Inventors: Kei Furukubo, Tokyo (JP); Yuudai Morikawa, Tokyo (JP); Misaki Koda, Tokyo (JP); Yutaka Aoyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/096,363

(22) PCT Filed: Jul. 14, 2016

(86) PCT No.: PCT/JP2016/070805
§ 371 (c)(1),
(2) Date: Oct. 25, 2018

(87) PCT Pub. No.: WO2018/011939
PCT Pub. Date: Jan. 18, 2018

(65) Prior Publication Data
US 2019/0128542 A1 May 2, 2019

(51) Int. Cl.
*F24F 1/36* (2011.01)
*F24F 1/14* (2011.01)
(Continued)

(52) U.S. Cl.
CPC ..... *F24F 1/36* (2013.01); *F24F 1/14* (2013.01); *F24F 1/56* (2013.01); *F24F 11/42* (2018.01)

(58) Field of Classification Search
CPC ..... F24F 1/36; F24F 1/56; F24F 1/14; F24F 11/42; F24F 2013/225; F24F 2013/227
(Continued)

(56) References Cited

U.S. PATENT DOCUMENTS 7,284,388 B2 * 10/2007 Yoshida ..... F28F 17/005 62/285
7,523,854 B2 * 4/2009 Gray ..... F24F 13/222 220/571
(Continued)

FOREIGN PATENT DOCUMENTS

JP H04-129035 U 11/1992
JP 2001-201108 A 7/2001
(Continued)

OTHER PUBLICATIONS

Office Action dated Oct. 1, 2019 issued in corresponding JP patent application No. 2018-527332 (and English translation).
(Continued)

*Primary Examiner* — Ana M Vazquez
(74) *Attorney, Agent, or Firm* — Posz Law Group, PLC

(57) ABSTRACT

An air-conditioning-apparatus outdoor unit includes a casing, a heat exchanger disposed in upper part of an inner space of the casing, a bottom plate located at a bottom of the casing and having a drain hole through which drain water that is generated on the heat exchanger is discharged outside, a support disposed in the inner space of the casing and supporting the heat exchanger in the upper part of the inner space of the casing, and a drain structure disposed under the heat exchanger and guiding the drain water to the bottom plate.

10 Claims, 9 Drawing Sheets

(51) Int. Cl.
*F24F 1/56* (2011.01)
*F24F 11/42* (2018.01)

(58) Field of Classification Search
USPC ..... 62/285
See application file for complete search history.

(56) References Cited

U.S. PATENT DOCUMENTS

| | | | |
|---|---|---|---|
| 2002/0134099 | A1 | 9/2002 | Mochizuki et al. |
| 2014/0202191 | A1 | 7/2014 | Jinnai et al. |
| 2014/0374078 | A1 | 12/2014 | Ono et al. |

FOREIGN PATENT DOCUMENTS

| | | | | |
|---|---|---|---|---|
| JP | 2002-022208 | A | | 1/2002 |
| JP | 2007-240094 | A | | 9/2007 |
| JP | 2010-071514 | A | | 4/2010 |
| JP | 2012-242026 | A | | 12/2012 |
| JP | 2013-139918 | A | | 7/2013 |
| JP | 2014-115007 | A | | 6/2014 |
| JP | 2014115007 | A | * | 6/2014 |
| JP | 2014-157008 | A | | 8/2014 |
| JP | 2015-206575 | A | | 11/2015 |

OTHER PUBLICATIONS

International Search Report of the International Searching Authority dated Aug. 16, 2016 for the corresponding international application No. PCT/JP2016/070805 (and English translation).
Examination Report dated Aug. 7, 2020 issued in corresponding GB patent application No. 1818998.5.

* cited by examiner

OUTDOOR UNIT FOR AIR-CONDITIONING APPARATUS

CROSS REFERENCE TO RELATED APPLICATION

This application is a U.S. national stage application of PCT/JP2016/070805 filed on Jul. 14, 2016, the disclosure of which is incorporated herein by reference.

TECHNICAL FIELD

The present invention relates to an air-conditioning-apparatus outdoor unit including a drain structure for carrying away drain water and a heat exchanger.

BACKGROUND ART

Air-conditioning apparatuses configured to perform a cooling operation or a heating operation by switching between refrigerant flow directions through a four-way valve are generally known. At low outdoor air temperatures, the heating operation of such an air-conditioning apparatus may cause frost formation on a heat exchanger of an outdoor unit, leading to a reduction in heat exchange efficiency. For this reason, outdoor units have a defrosting function of removing frost.

In such an outdoor unit, water formed by melting frost in the defrosting operation is allowed to downwardly flow as water to be drained, or drain water, and is then received by a bottom plate of the outdoor unit. After that, the water is discharged outside through a drain hole located in the bottom plate. However, a small amount of drain water received by the bottom plate may fail to reach the drain hole and thus remain on the bottom plate. The drain water remaining on the bottom plate may freeze again at outdoor air temperatures below the freezing point during the heating operation resumed after completion of the defrosting operation. Periodically repeating the defrosting operation for the heat exchanger promotes the growth of the frozen drain water, or ice. Unfortunately, the heat exchanger may be covered with ice, leading to a reduction in heating capacity. Furthermore, growing ice may press and squeeze a refrigerant pipe. For example, Patent Literature 1 and 2 disclose a technique for preventing drain water from freezing by using an antifreezing heater disposed on a bottom plate of an outdoor unit.

CITATION LIST

Patent Literature

Patent Literature 1: Japanese Unexamined Patent Application Publication No. 2010-71514

Patent Literature 2: Japanese Unexamined Patent Application Publication No. 2015-206575

SUMMARY OF INVENTION

Technical Problem

If an antifreezing heater is disposed on a bottom plate as in air-conditioning-apparatus outdoor units disclosed in Patent Literature 1 and 2, freezing cannot be completely prevented. Specifically, ice surrounding the antifreezing heater can actually be melted by a thickness of several millimeters such that a cavity is formed inside the ice. In such an outdoor unit including an antifreezing heater, ice may grow beyond the antifreezing heater and completely cover the bottom plate, and a refrigerant pipe of a heat exchanger may be broken. Although the thermal capacity of the antifreezing heater in the outdoor unit can be increased to melt ice, such a measure requires extra power supply, leading to an increase in running cost. Furthermore, the outdoor unit including the antifreezing heater has a complex structure or requires complicated control, leading to an increase in product cost.

The present invention has been made to overcome the above-described disadvantages, and aims to provide an air-conditioning-apparatus outdoor unit that can prevent a reduction in heating capacity of a heat exchanger and breakage of a refrigerant pipe without using an antifreezing heater.

Solution to Problem

An air-conditioning-apparatus outdoor unit according to an embodiment of the present invention includes: a casing; a heat exchanger disposed in upper part of an inner space of the casing; a bottom plate located at a bottom of the casing, the bottom plate having a drain hole through which drain water that is generated on the heat exchanger is discharged outside; a support disposed in the inner space of the casing, the support supporting the heat exchanger in the upper part of the inner space of the casing; and a drain structure disposed under the heat exchanger, the drain structure guiding the drain water to the bottom plate.

Advantageous Effects of Invention

The air-conditioning-apparatus outdoor unit according to the embodiment of the present invention is configured such that the support disposed on the bottom plate supports the heat exchanger in the upper part of the inner space of the casing and the drain water that is generated on the heat exchanger is guided to the bottom plate through the drain structure disposed under the heat exchanger. This configuration reduces or eliminates the likelihood that the heat exchanger located in the upper part of the inner space of the casing will be covered with frozen water if the drain water fails to be discharged outside through the drain hole of the bottom plate and remains and freezes on the bottom plate. Advantageously, the air-conditioning-apparatus outdoor unit according to the embodiment of the present invention can prevent a reduction in heating capacity of the heat exchanger and breakage of a refrigerant pipe without using an antifreezing heater.

DESCRIPTION OF EMBODIMENTS

Embodiment 1

Figure 1:
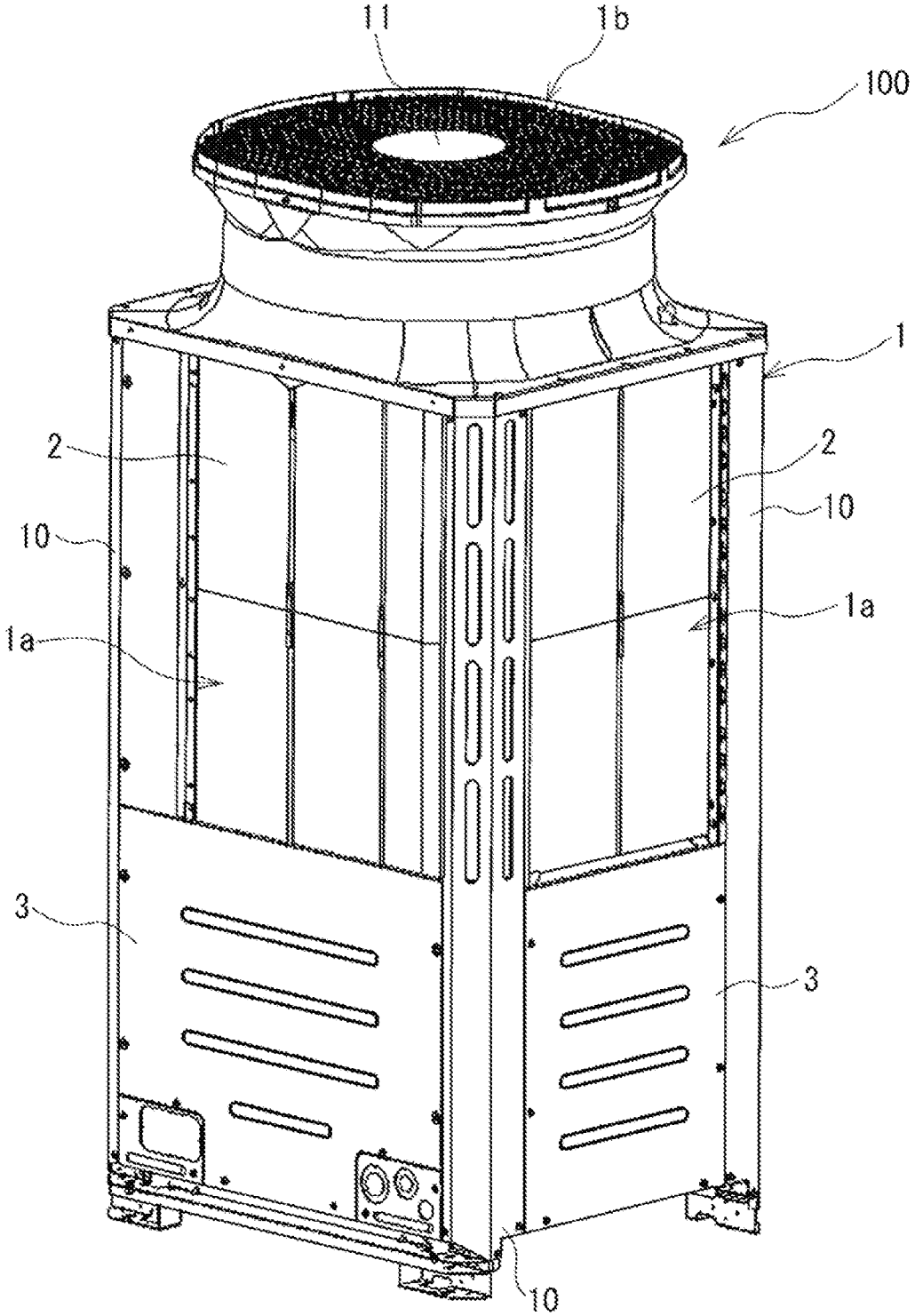
FIG. 1 is a schematic perspective view of an air-conditioning-apparatus outdoor unit according to Embodiment 1 of the present invention.

An air-conditioning-apparatus outdoor unit according to embodiments of the present invention will be described below with reference to the drawings. Note that the forms of components illustrated in the drawings are for illustrative purposes only, and should not be construed as limiting the present invention. Furthermore, note that the components designated by the same reference signs in the figures are the same components or equivalents. This applies to the entire description herein. Furthermore, note that the relative sizes of the components illustrated in the following figures may differ from the actual relative sizes of the components.

Figure 2:
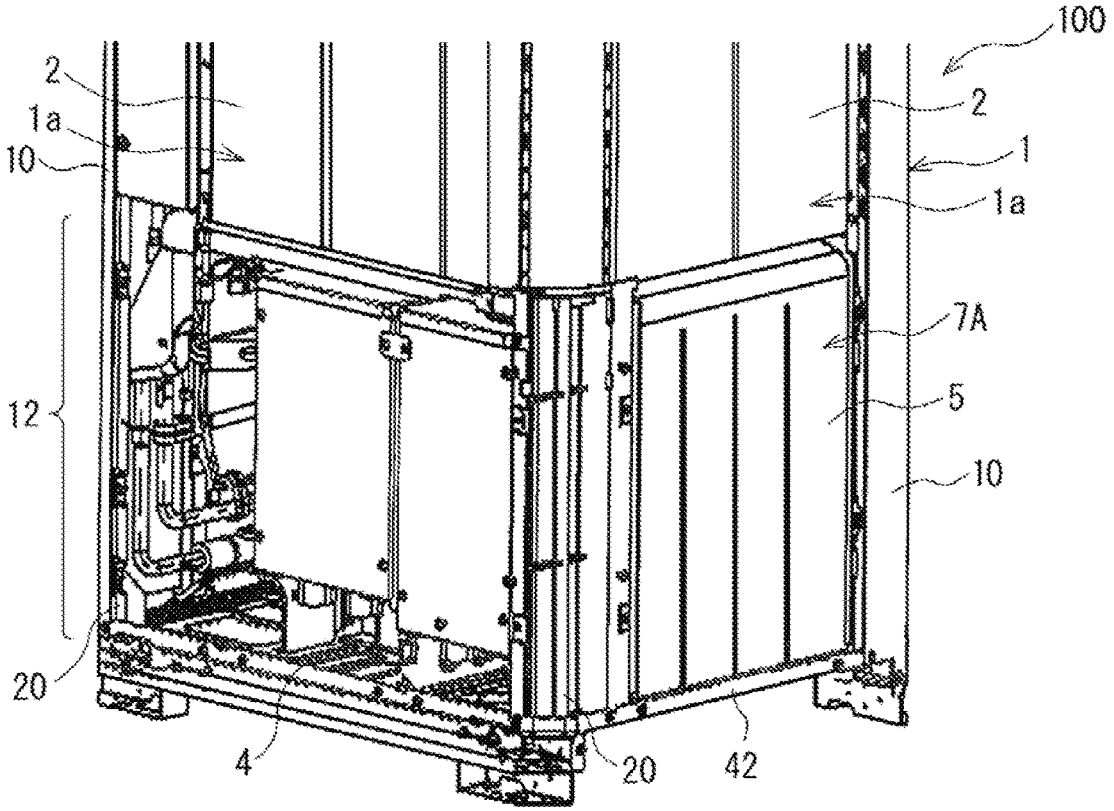
FIG. 2 is a schematic enlarged perspective view illustrating an internal configuration of the air-conditioning-apparatus outdoor unit according to Embodiment 1 of the present invention.

FIG. 1 is a schematic perspective view of an air-conditioning-apparatus outdoor unit according to Embodiment 1 of the present invention. FIG. 2 is a schematic enlarged perspective view illustrating an internal configuration of the air-conditioning-apparatus outdoor unit according to Embodiment 1 of the present invention. As illustrated in FIGS. 1 and 2, an outdoor unit 100 according to Embodiment 1 includes a substantially rectangular cuboid-shaped casing 1 placed vertically, a heat exchanger 2 disposed in upper part of an inner space of the casing 1, a bottom plate 4 having drain holes 40 through which drain water that is generated on the heat exchanger 2 is discharged outside, supports 20 supporting the heat exchanger 2 in the upper part of the inner space of the casing 1, and a drain structure 7A guiding the drain water to the bottom plate 4.

The casing 1 includes frame members 10 extending upwardly from the corners of the bottom plate 4 located at the bottom of the casing. The casing 1 has an air inlet 1*a*, through which air is taken into the casing 1, located in upper parts of outer side surfaces of the casing surrounded by the frame members 10. The heat exchanger 2 is disposed along the air inlet 1*a*. The casing 1 has an air outlet 1*b* located at the top of the casing. In the inner space of the casing 1, a fan 11 is disposed under the air outlet 1*b*. Driving the fan 11 causes the air taken into the casing 1 through the air inlet 1*a* to exchange heat with refrigerant while passing through the heat exchanger 2, pass through the fan 11, and be discharged through the air outlet 1*b*.

The casing 1 includes side panels 3, which are designed metal sheets, arranged in lower parts of the outer side surfaces of the casing surrounded by the frame members 10. The side panels 3 cover the lower parts of the outer side surfaces of the casing. Right and left ends of the side panels 3 are fastened to the frame members 10 by using fasteners, such as screws, and lower ends of the side panels are fastened to the bottom plate 4 by using fasteners, such as screws. As illustrated in FIG. 2, internal components 12, such as a compressor and an accumulator, are arranged in lower part of the inner space of the casing 1 and are located under the heat exchanger 2. The outdoor unit 100 can be opened by removing the side panel 3 from the casing 1, thus allowing maintenance of the internal components 12, for example.

The heat exchanger 2 exchanges heat between the refrigerant supplied to the heat exchanger 2 and the air passing through the heat exchanger 2. In the cooling operation, the heat exchanger 2 functions as a condenser to condense and liquify the refrigerant. In the heating operation, the heat exchanger 2 functions as an evaporator to evaporate and gasify the refrigerant. Although not illustrated in detail, the heat exchanger 2 is a combination of two L-shaped heat exchanger elements, and thus has a substantially rectangular shape. The heat exchanger 2 is disposed such that outer side surfaces thereof extend along inner side surfaces of the casing 1. The heat exchanger 2 is supported by the supports 20 arranged in the inner space of the casing 1 such that the heat exchanger is located in the upper part of the inner space of the casing 1.

Figure 3:
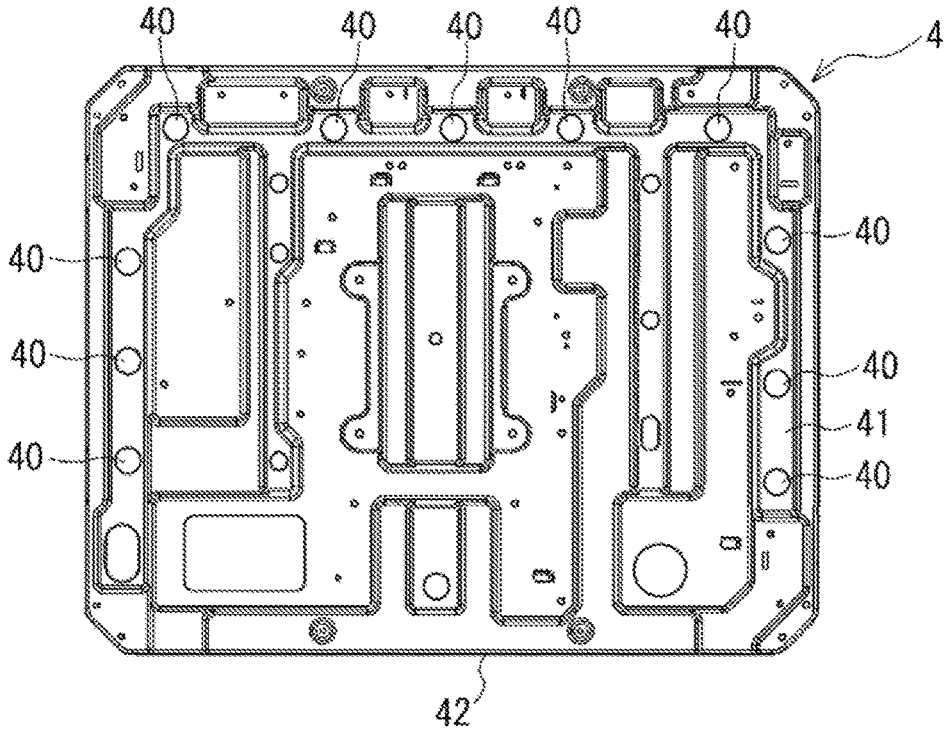
FIG. 3 is a top view of the structure of a bottom plate of the air-conditioning-apparatus outdoor unit according to Embodiment 1 of the present invention.

FIG. 3 is a top view of the structure of the bottom plate of the air-conditioning-apparatus outdoor unit according to Embodiment 1 of the present invention. As illustrated in FIG. 3, the bottom plate 4 is substantially rectangular, and is located at the bottom of the casing 1 so that the internal components 12 are placed on the bottom plate. The bottom plate 4 includes raised part 42 formed by upwardly bending outer peripheral part of the bottom plate. The bottom plate 4 further has the drain holes 40, through which drain water formed by melting frost in the defrosting operation is discharged outside, and a drain groove 41 for guiding the drain water to the drain holes 40. Lower ends of the supports 20 supporting the heat exchanger 2 are fixed to the respective corners of the bottom plate 4.

Figure 4:
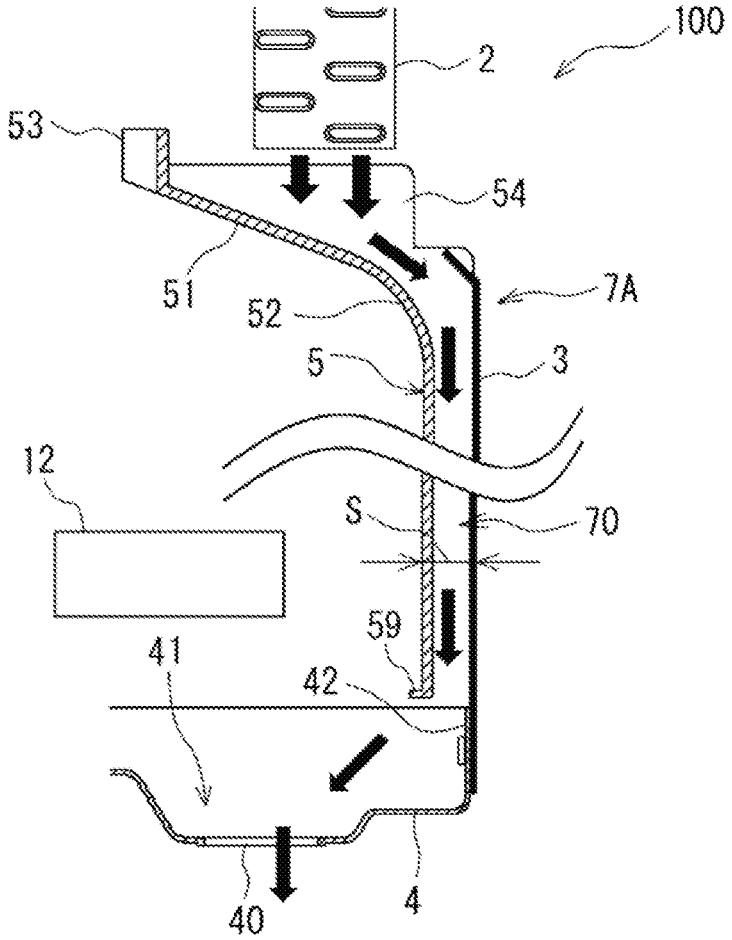
FIG. 4 is a schematic sectional view illustrating a drain structure of the air-conditioning-apparatus outdoor unit according to Embodiment 1 of the present invention.
Figure 5A:
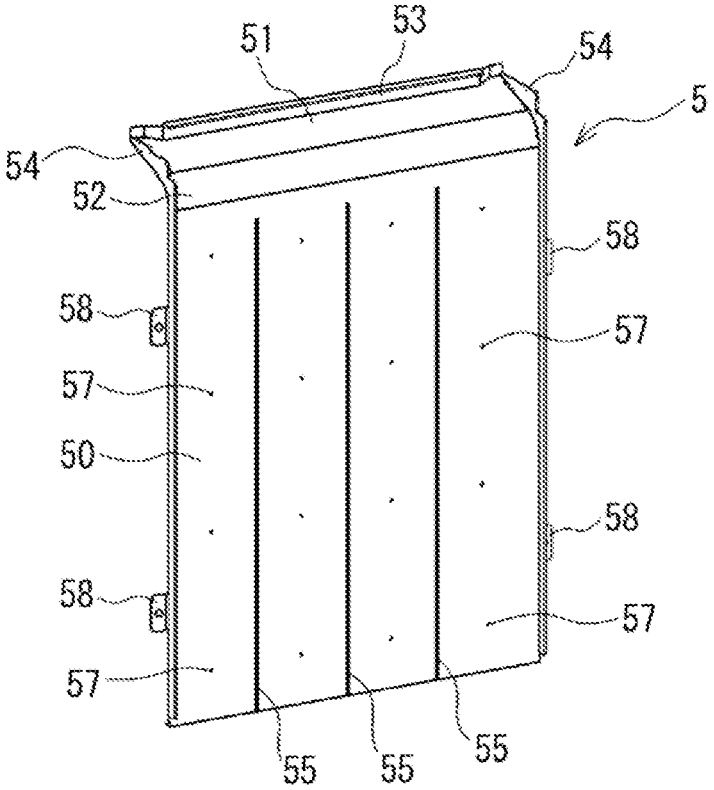
FIG. 5A is a perspective view illustrating a drain surface of a water guide plate of the air-conditioning-apparatus outdoor unit according to Embodiment 1 of the present invention.
Figure 5B:
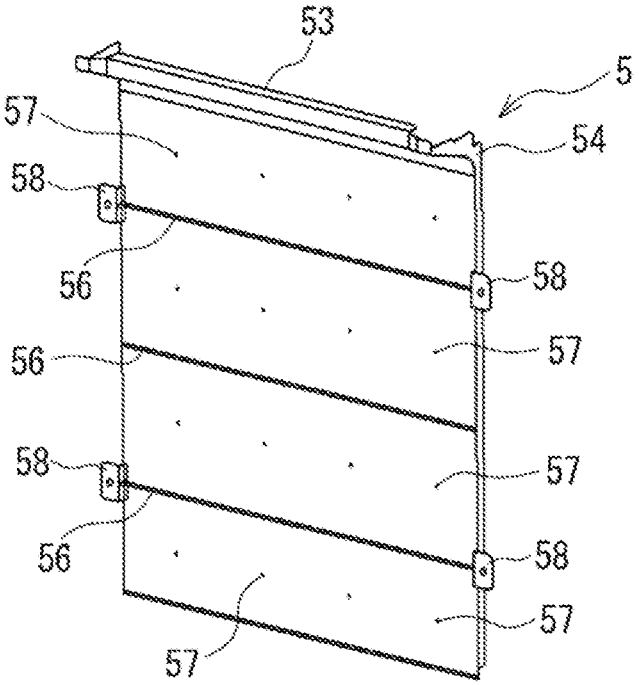
FIG. 5B is a perspective view illustrating a rear surface of the water guide plate of the air-conditioning-apparatus outdoor unit according to Embodiment 1 of the present invention.

FIG. 4 is a schematic sectional view illustrating the drain structure of the air-conditioning-apparatus outdoor unit according to Embodiment 1 of the present invention. FIG. 5A is a perspective view illustrating a drain surface of a water guide plate of the air-conditioning-apparatus outdoor unit according to Embodiment 1 of the present invention. FIG. 5B is a perspective view illustrating a rear surface of the water guide plate of the air-conditioning-apparatus outdoor unit according to Embodiment 1 of the present invention. As illustrated in FIG. 4, the drain structure 7A includes the side panel 3 and a water guide plate 5 disposed in the inner space of the casing 1. The water guide plate 5 is positioned at a distance S from the side panel 3 such that the water guide plate 5 faces the side panel 3 to define a drain path 70 for drain water therebetween. The drain path 70 is a path that allows drain water formed by melting frost in the defrosting operation to flow downward (in a direction indicated by arrows in FIG. 4) in the outdoor unit 100, and guides the drain water to the drain groove 41 of the bottom plate 4. To provide a space for the internal components 12 arranged inside the casing 1 as large as possible, the distance S between the water guide plate 5 and the side panel 3 is calculated from minimum necessary volumes of water, such as rainwater, in environments other than cold climate environments.

As illustrated in FIGS. 4, 5A, and 5B, the water guide plate 5 is a substantially tabular member formed from, for example, low thermal conductivity synthetic resin or rubber. The reason why the low thermal conductivity material is used is to prevent drain water flowing from the heat exchanger 2 from freezing readily when heat is removed from the drain water by the water guide plate 5. The water guide plate 5 includes in its upper end part a slope 51 that slopes toward inside of the casing and obliquely upward at the upper end part of the water guide plate at substantially 30 degrees in the casing 1. As illustrated in FIG. 4, an upper end of the slope 51 is located above an upper end of the side panel 3. The upper end of the slope 51 includes a flange 53 that extends upward to prevent dropping drain water from entering the inner space of the casing 1. The water guide plate 5 is not in contact with the heat exchanger 2.

The water guide plate 5 includes a curve 52 formed by rounding angled part extending from the slope 51 to part facing the side panel 3. The curve 52 enables drain water dropping from the heat exchanger 2 to be smoothly guided downward through the drain path 70 without stagnating on the slope 51. The water guide plate 5 further includes flanges 54 that extend from the edges of right and left sides of the water guide plate and close the drain path 70, thus preventing drain water from entering the inner space of the casing 1. As illustrated in FIG. 5A, both the sides of the water guide plate 5 are fastened to the supports 20 by attachment lugs 58 respectively extending from the right and left flanges 54. The attachment lugs 58 each have a hole through which a fastener, such as a bolt or a screw, extends, and are fastened to the supports 20 by the fasteners extending through the holes. Although two attachment lugs 58 are arranged vertically on each of the right and left flanges 54 in FIGS. 5A and 5B, other configurations can be applied as long as at least one attachment lug 58 is disposed on each of the right and left flanges.

A drain surface 50 of the water guide plate 5 includes three vertical ribs 55 for reinforcement spaced horizontally from each other. A rear surface of the water guide plate 5 includes three horizontal ribs 56 for reinforcement spaced vertically from each other. Assuming that the water guide plate 5 is a flat resin molding, the vertical ribs 55 and the horizontal ribs 56 are arranged to prevent the water guide plate 5 from warping when the water guide plate is molded. The vertical ribs 55 extend in the vertical direction, which is the same as a direction in which the drain water flows, such that the drain path 70 is not hindered by the vertical ribs. The number of vertical ribs 55 and the number of horizontal ribs 56 are not limited to those illustrated in FIGS. 5A and 5B.

The water guide plate 5 further has a plurality of through-holes 57 open from the drain path 70 to the inner space of the casing 1. The through-holes 57 serves as relief holes for relieving freezing-induced expansion, or keeping the drain path 70 from expanding while freezing and melting are repeated. The through-holes 57 are arranged to prevent expansion induced by freezing. FIGS. 5A and 5B illustrate an array of 4 by 4 through-holes 57 spaced from each other vertically and horizontally. However, the through-holes 57 may be arranged in any pattern such that the number and size of through-holes are appropriately adjusted.

Although not illustrated in detail, the drain surface 50 of the water guide plate 5, which is a resin molding, may have crimps or grooves to improve water repellency.

In a typical outdoor unit, drain water formed by melting frost in the defrosting operation may fail to reach drain holes and remain on a bottom plate of the outdoor unit. The drain water remaining on the bottom plate may freeze again at outdoor air temperatures below the freezing point during the heating operation resumed after completion of the defrosting operation. Periodically repeating the defrosting operation for a heat exchanger promotes the growth of the frozen drain water, or ice. Unfortunately, the heat exchanger may be covered with ice, leading to a reduction in heating capacity. Furthermore, growing ice may press and squeeze a refrigerant pipe included in the heat exchanger.

The air-conditioning-apparatus outdoor unit 100 according to Embodiment 1 is configured such that the supports 20 arranged on the bottom plate 4 support the heat exchanger 2 in the upper part of the inner space of the casing 1 and drain water that is generated on the heat exchanger 2 is guided to the bottom plate 4 through the drain structure 7A located under the heat exchanger 2. In the outdoor unit 100, if the drain water fails to be discharged outside through the drain holes 40 of the bottom plate 4 and remains and freezes on the bottom plate 4, the heat exchanger 2 located in the upper part of the inner space of the casing 1 will not be covered with ice. This configuration can prevent a reduction in heating capacity of the heat exchanger 2 and breakage of refrigerant pipes without using an antifreezing heater.

The water guide plate 5 includes the slope 51 located in the upper end part such that the slope slopes toward inside of the casing and obliquely upward at the upper end part of the water guide plate. Since the upper end of the slope 51 is located above the upper end of the side panel 3, drain water formed by melting frost on the heat exchanger 2 in the defrosting operation can be guided to the drain path 70 without entering the inner space of the casing 1.

In addition, the water guide plate 5 includes the curve 52 formed by rounding the angled part extending from the slope 51 to the drain surface 50. The curve 52 enables the drain water dropping from the heat exchanger 2 to be smoothly guided downward through the drain path 70 without stagnating on the slope 51.

Additionally, the water guide plate 5 has the multiple through-holes 57 open from the drain path 70 to the inner space of the casing 1. The through-holes 57 serve as relief holes for relieving freezing-induced expansion, or keeping the drain path 70 from expanding while freezing and melting are repeated, thus preventing expansion induced by freezing.

Figure 6A:
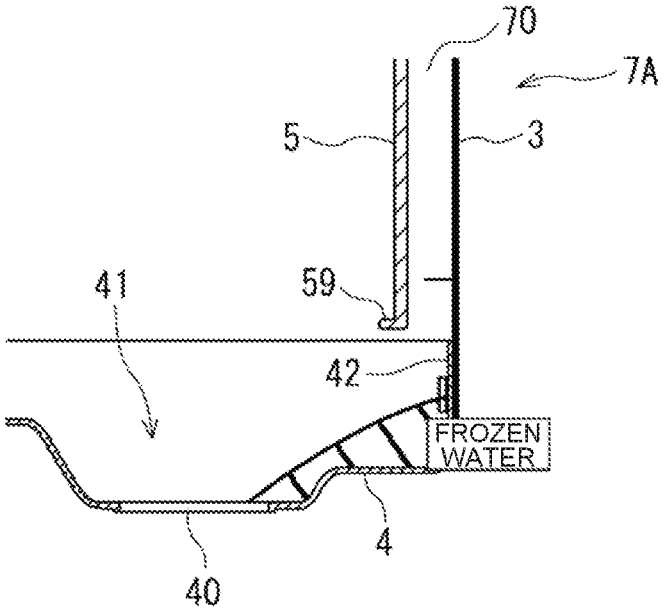
FIG. 6A is a diagram illustrating an initial frozen state of drain water accumulating on the bottom plate of the air-conditioning-apparatus outdoor unit according to Embodiment 1 of the present invention.
Figure 6B:
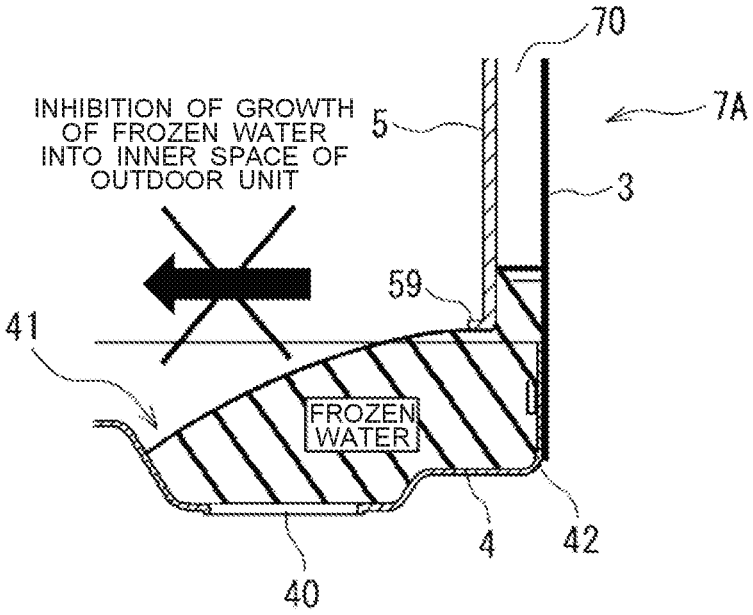
FIG. 6B is a diagram illustrating an increased state of the frozen water on the bottom plate of the air-conditioning-apparatus outdoor unit according to Embodiment 1 of the present invention.

The position of a lower end of the water guide plate 5 will now be described. FIG. 6A is a diagram illustrating an initial frozen state of drain water accumulating on the bottom plate of the air-conditioning-apparatus outdoor unit 100 according to Embodiment 1 of the present invention. FIG. 6B illustrates a grown state of the frozen water on the bottom plate of the air-conditioning-apparatus outdoor unit according to Embodiment 1 of the present invention. As illustrated in FIGS. 6A and 6B, performing the defrosting operation several times in the outdoor unit 100 causes a phenomenon in which drain water remaining on the bottom plate 4 freezes and grows into a thick ice layer originating from a location immediately beneath the drain path 70. For this reason, the outdoor unit 100 according to Embodiment 1 is configured such that the lower end of the water guide plate 5 is located slightly above an upper end of the raised part 42 of the bottom plate 4. Furthermore, the water guide plate 5 includes a flange 59 that is located in lower end part of the water guide plate and protrudes inward in the casing 1. Specifically, as illustrated in FIG. 6B, repeatedly performing the defrosting operation causes the drain path 70 to be blocked at the lower end of the water guide plate 5 by frozen water. This prevents the frozen water from growing and entering the inner space of the casing 1. In addition, the lower end of the water guide plate 5 is located slightly above the upper end of the raised part 42. Therefore, this arrangement facilitates removal of the water guide plate 5 for maintenance inside the casing 1, thus improving workability.

Figure 7:
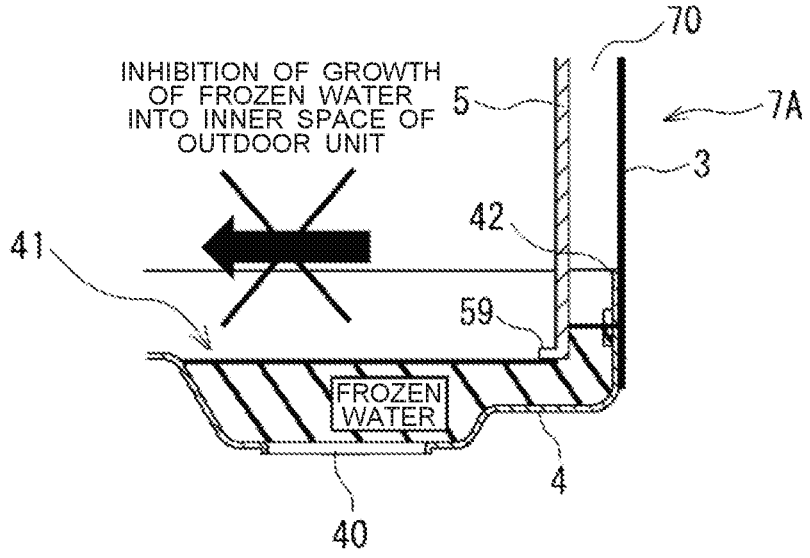
FIG. 7 is a diagram illustrating another frozen state of the drain water accumulating on the bottom plate of the air-conditioning-apparatus outdoor unit according to Embodiment 1 of the present invention.

FIG. 7 is a diagram illustrating another frozen state of drain water accumulating on the bottom plate of the air-conditioning-apparatus outdoor unit according to Embodiment 1 of the present invention. As illustrated in FIG. 7, the lower end of the water guide plate 5 may be positioned below the upper end of the raised part 42 of the bottom plate 4. In the outdoor unit 100 illustrated in FIG. 7, if the defrosting operation is performed repeatedly and the bulk of frozen drain water that has accumulated in the drain groove 41 increases accordingly, the lower end of the water guide plate 5 can inhibit the growth of the frozen water to keep the frozen water within the drain groove 41. This reduces or eliminates the likelihood that frozen water may enter the inner space of the casing 1 while growing.

Figure 8:
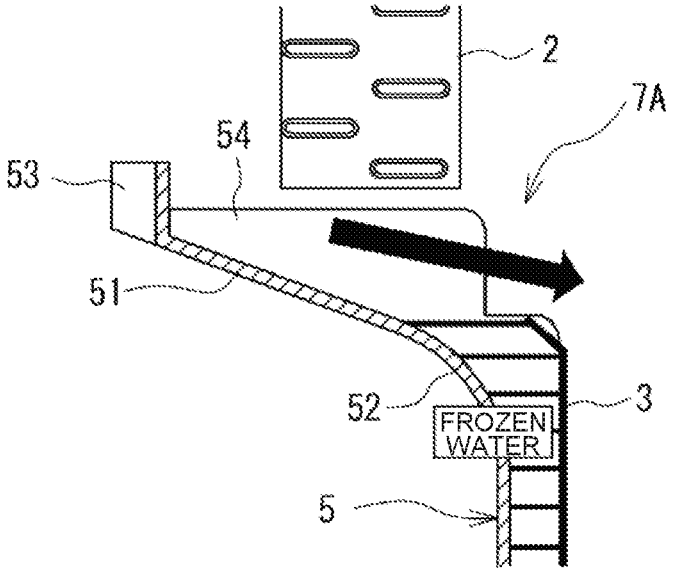
FIG. 8 is a diagram illustrating a frozen state of the drain water in upper part of a drain path of the air-conditioning-apparatus outdoor unit according to Embodiment 1 of the present invention.

FIG. 8 is a diagram illustrating a frozen state of drain water in upper part of the drain path of the air-conditioning-apparatus outdoor unit according to Embodiment 1 of the present invention. To leave a sufficient space in the casing 1, the outdoor unit 100 is configured such that the distance S between the side panel 3 and the water guide plate 5 is set to a necessary minimum distance that allows for drainage. In cold climate environments, lower part of the drain path 70 in the outdoor unit 100 may be filled with frozen water as illustrated in FIG. 5B and, after that, the frozen water may grow upward in the drain path 70. However, the outdoor unit 100 according to Embodiment 1 is configured such that the upper end of the slope 51 of the water guide plate 5 is positioned above the upper end of the side panel 3. If the frozen water has grown to be higher than the side panel 3 as illustrated in FIG. 8, drain water will be discharged outside through a gap between the heat exchanger 2 and the side panel 3 without entering the inner space of the outdoor unit 100. This configuration minimizes the amount of frozen water in the casing 1, thus preventing breakage of a constituent pipe.

Figure 9:
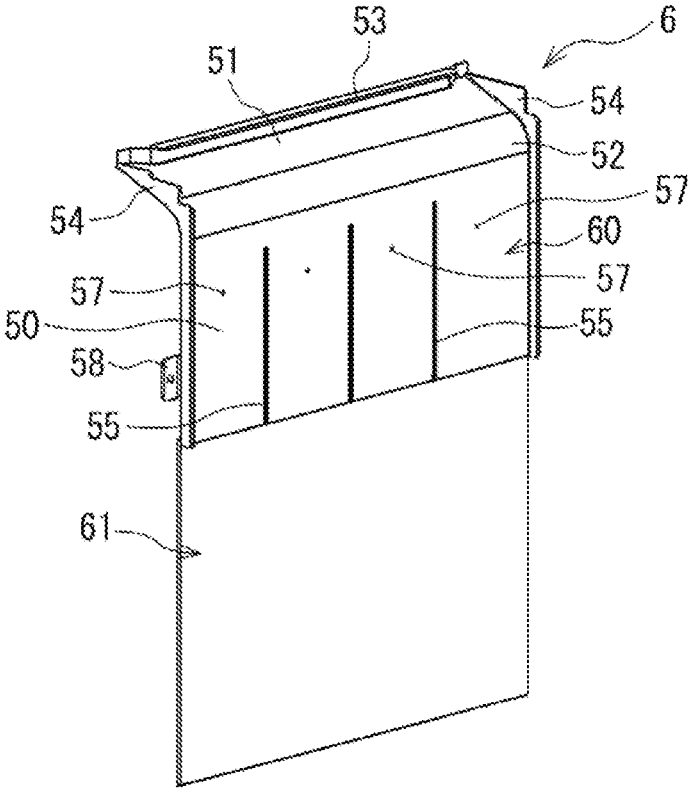
FIG. 9 is a perspective view of a modification of the water guide plate of the air-conditioning-apparatus outdoor unit according to Embodiment 1 of the present invention.

FIG. 9 is a perspective view of a modification of the water guide plate of the air-conditioning-apparatus outdoor unit according to Embodiment 1 of the present invention. A water guide plate 6 illustrated in FIG. 9 includes an upper member 60, serving as an upper portion including the slope 51, formed from synthetic resin and a lower member 61, serving as a lower portion extending from middle part to the lower end, formed of a rubber sheet. In other words, the water guide plate 6 is a combination of a synthetic resin member and a rubber member. Such a configuration enables the proportion of a resin molding in the water guide plate 6 to be lower than that in the water guide plate formed only of a resin molding, thus reducing the cost of a mold.

Embodiment 2

Figure 10:
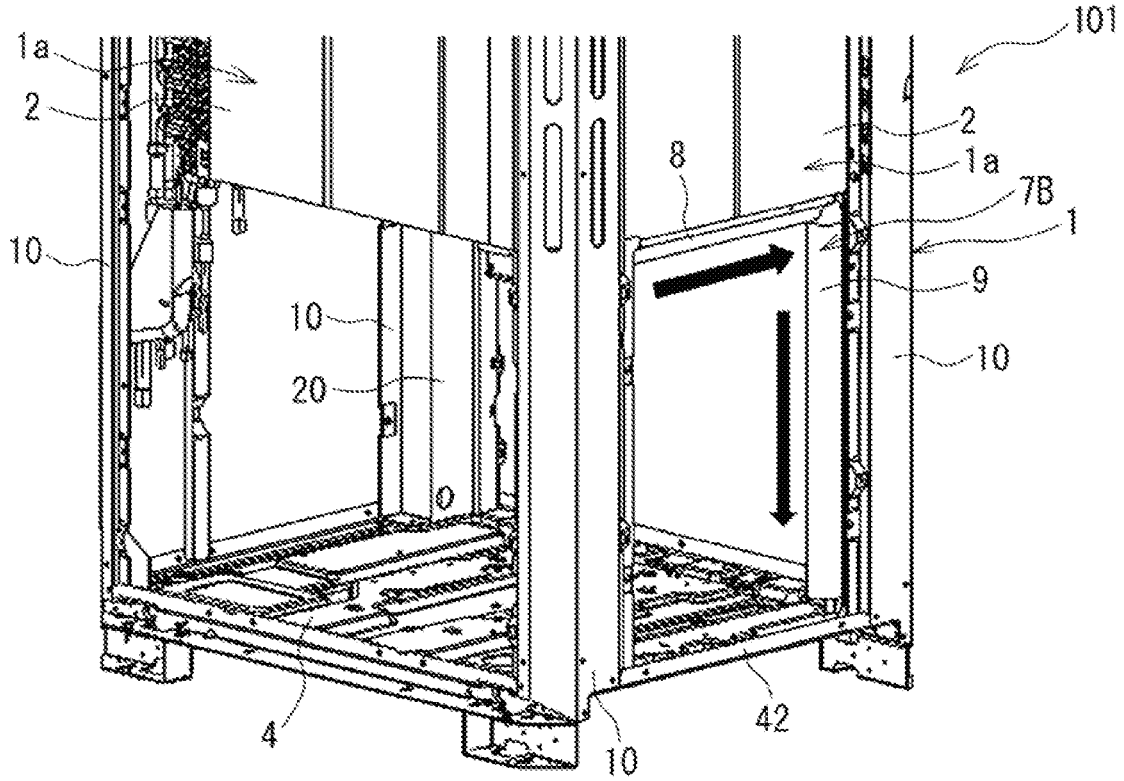
FIG. 10 is a schematic enlarged perspective view illustrating an internal configuration of an air-conditioning-apparatus outdoor unit according to Embodiment 2 of the present invention.
Figure 11:
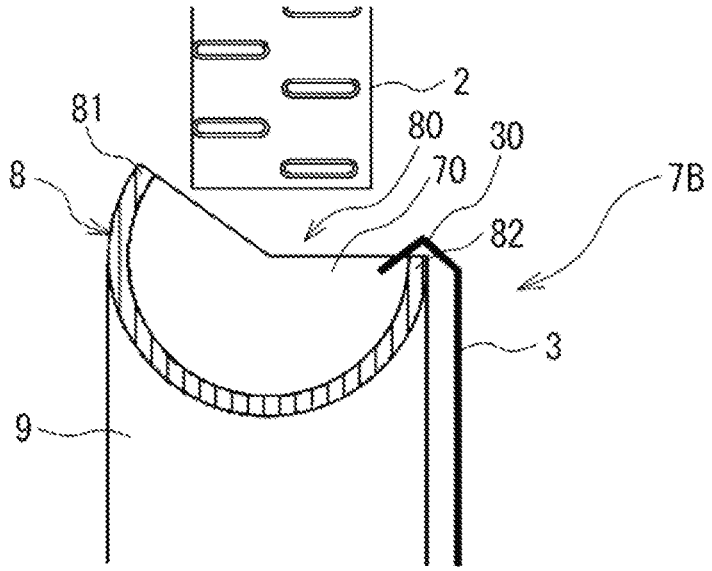
FIG. 11 is a schematic sectional view illustrating a drain structure of the air-conditioning-apparatus outdoor unit according to Embodiment 2 of the present invention.

An air-conditioning-apparatus outdoor unit according to Embodiment 2 will be described with reference to FIGS. 10 and 11. FIG. 10 is a schematic enlarged perspective view illustrating an internal configuration of the air-conditioning-apparatus outdoor unit according to Embodiment 2 of the present invention. FIG. 11 is a schematic sectional view illustrating a drain structure of the air-conditioning-apparatus outdoor unit according to Embodiment 2 of the present invention. The same components as those of the air-conditioning-apparatus outdoor unit 100 described in Embodiment 1 are designated by the same reference signs and descriptions of these components are omitted as appropriate.

An air-conditioning-apparatus outdoor unit 101 according to Embodiment 2 includes a drain structure 7B, which differs in configuration from the drain structure 7A in Embodiment 1 described above. Specifically, as illustrated in FIGS. 10 and 11, the drain structure 7B of the air-conditioning-apparatus outdoor unit 101 according to Embodiment 2 includes the side panel 3, a first water guide pipe 8 disposed along a lower end face of the heat exchanger 2, and a second water guide pipe 9, connected to the first water guide pipe 8, for guiding drain water to the bottom plate 4. The first water guide pipe 8 and the second water guide pipe 9 define the drain path 70. In other words, the outdoor unit 101 is configured such that the first water guide pipe 8 receives and horizontally guides drain water formed on the heat exchanger 2 and the second water guide pipe 9 collectively allows the drain water to flow downward in the casing 1. FIG. 10 illustrates the casing 1 with the side panels 3 removed. In FIG. 10, the depiction of the internal components 12, which are illustrated in FIG. 2, is omitted.

The side panels 3 are designed metal sheets covering the lower parts of the outer side surfaces surrounded by the frame members 10. As illustrated in FIG. 11, each side panel 3 includes in its upper end part a hook 30 to catch an opening edge 82 of the first water guide pipe 8. The right and left ends of the side panel 3 are fastened to the frame members 10 by using fasteners, such as screws, and the lower end of the side panel is fastened to the bottom plate 4 by using fasteners, such as screws. As illustrated in FIG. 10, the outdoor unit 101 can be opened by removing the side panels 3 from the casing 1, thus allowing maintenance of the internal components 12 (see FIG. 2), for example.

The first water guide pipe 8 and the second water guide pipe 9 are formed from, for example, low thermal conductivity synthetic resin or rubber. The reason why the low thermal conductivity material is used is to prevent drain water flowing from the heat exchanger 2 from freezing readily when heat is removed from the drain water by the first water guide pipe 8 and the second water guide pipe 9. As illustrated in FIG. 10, the first water guide pipe 8 is disposed along the lower end face of the heat exchanger 2 in the casing 1, and horizontally extends between the frame members 10. The first water guide pipe 8 has an opening 80 facing the lower end face of the heat exchanger 2. As illustrated in FIG. 11, the first water guide pipe 8 has an inner opening edge 81 adjacent to the inner space of the casing 1 and the outer opening edge 82 adjacent to the outside of the casing 1, the inner opening edge 81 is positioned above the lower end face of the heat exchanger 2, and the outer opening edge 82 is positioned below the lower end face of the heat exchanger 2. This arrangement prevents dropping drain water from entering the inner space of the casing 1. The first water guide pipe 8 is not in contact with the heat exchanger 2.

As illustrated in FIG. 10, the second water guide pipe 9 is disposed parallel to the support 20 extending between the heat exchanger 2 and the bottom plate 4. An upper end of the second water guide pipe 9 is connected to the first water guide pipe 8. The second water guide pipe 9 is preferably firmly fixed to, for example, the support 20.

In the air-conditioning-apparatus outdoor unit 101 according to Embodiment 2, performing the defrosting operation several times causes a phenomenon in which drain water remaining on the bottom plate 4 freezes and grows into a thick ice layer, originating from a location immediately beneath the drain path 70, in the drain groove 41 of the bottom plate 4. For this reason, as described with reference to FIG. 6, the outdoor unit 101 according to Embodiment 2 is also configured such that the lower end of the second water guide pipe 9 is located slightly above the upper end of the raised part 42 of the bottom plate 4. Alternatively, as described with reference to FIG. 7, the lower end of the second water guide pipe 9 may be located below the upper end of the raised part 42 of the bottom plate 4.

The air-conditioning-apparatus outdoor unit 101 according to Embodiment 2 is therefore configured such that the supports 20 arranged on the bottom plate 4 support the heat exchanger 2 in the upper part of the inner space of the casing 1 and drain water formed on the heat exchanger 2 is guided to the bottom plate 4 through the drain structure 7B located under the heat exchanger 2. In the air-conditioning-apparatus outdoor unit 101 according to Embodiment 2, if drain water fails to be discharged outside through the drain holes 40 of the bottom plate 4 and remains and freezes on the bottom plate 4, the heat exchanger 2 located in the upper part of the inner space of the casing 1 will not be covered with ice. This configuration can prevent a reduction in heating capacity of the heat exchanger 2 and breakage of the refrigerant pipes without using an antifreezing heater.

Figure 12:
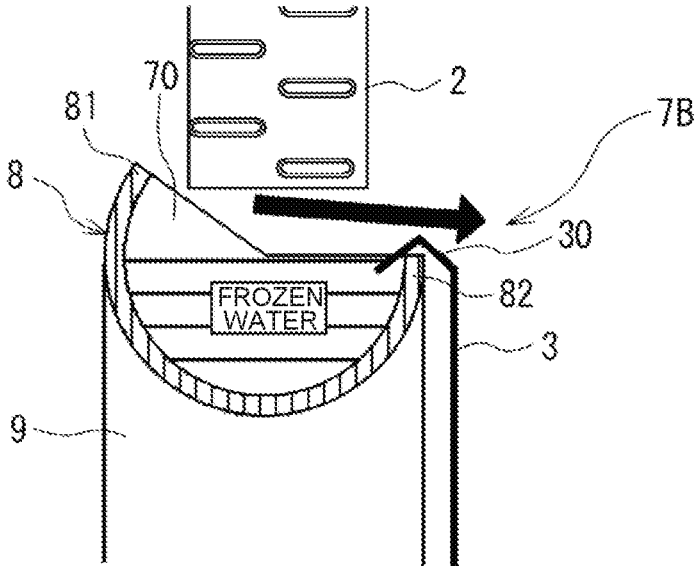
FIG. 12 is a diagram illustrating a frozen state of drain water in upper part of a drain path of the air-conditioning-apparatus outdoor unit according to Embodiment 2 of the present invention.

FIG. 12 is a diagram illustrating a frozen state of drain water in upper part of the drain path of the air-conditioning-apparatus outdoor unit according to Embodiment 2 of the present invention. To leave a sufficient space in the casing 1, the outdoor unit 101 is configured such that the first water guide pipe 8 has a necessary minimum outside diameter that allows for drainage. In cold climate environments, the lower part of the drain path 70 in the outdoor unit 101 may be filled with frozen water and, after that, the frozen water may grow upward in the drain path 70. However, the outdoor unit 101 according to Embodiment 2 is configured such that the inner opening edge 81, located adjacent to the inner space of the casing 1, of the first water guide pipe 8 is positioned above the lower end face of the heat exchanger 2 and the outer opening edge 82, located adjacent to the outside of the casing 1, of the first water guide pipe is positioned below the lower end of the heat exchanger 2. In addition, the outdoor unit 101 is configured such that the side panel 3 is attached to the first water guide pipe 8 by the hook. In this configuration, if the frozen water increases over the side panel 3, drain water will be discharged outside through the gap between the heat exchanger 2 and the side panel 3 without entering the inner space of the outdoor unit 100. This configuration minimizes the amount of frozen water in the casing 1, thus preventing breakage of a constituent pipe.

Although the present invention has been described based on the embodiments, the present invention is not intended to be limited by the configurations in the above-described embodiments. For example, the internal configurations of the illustrated outdoor units are for illustrative purposes only, and are not limited by the foregoing details. The present invention can be similarly embodied in an outdoor unit including any other component. In other words, it should be emphasized that various modifications, applications, and uses made by those skilled in the art as needed fall within the spirit and scope (technical scope) of the present invention.

REFERENCE SIGNS LIST

1 casing 1*a* air inlet 1*b* air outlet 2 heat exchanger 3 side panel 4 bottom plate 5, 6 water guide plate 7A, 7B drain structure 8 first water guide pipe 9 second water guide pipe 10 frame member 11 fan 12 internal components 20 support 30 hook 40 drain hole 41 drain groove 42 raised part 50 drain surface 51 slope 52 curve 53, 54, 59 flange 55 vertical rib 56 horizontal rib 57 through-hole 58 attachment lug 60 upper member 61 lower member 70 drain path 80 opening 81, 82 opening edge 100, 101 outdoor unit

The invention claimed is:

1. An outdoor unit for an air-conditioning apparatus, the outdoor unit comprising:

a casing;

a heat exchanger disposed in an upper part of an inner space of the casing;

a bottom plate located at a bottom of the casing, the bottom plate having a drain hole through which drain water that is generated on the heat exchanger is discharged outside;

a support disposed in the inner space of the casing, the support supporting the heat exchanger in the upper part of the inner space of the casing; and a drain structure disposed under the heat exchanger, the drain structure guiding the drain water to the bottom plate, wherein the drain structure includes a side panel covering an outer side surface of the casing; and a water guide plate disposed in the inner space of the casing, the water guide plate facing the side panel to define a drain path for the drain water between the water guide plate and the side panel, and wherein the water guide plate has a plurality of through-holes extending inward from the drain path in the casing.

2. The outdoor unit of claim 1, wherein the water guide plate includes a slope in an upper end part of the water guide plate, the slope sloping toward inside of the casing and obliquely upward at the upper end part of the water guide plate, and an upper end of the slope is located above an upper end of the side panel.

3. The outdoor unit of claim 2, wherein the water guide plate includes a curve formed by rounding angled part extending from the slope to part facing the side panel.

4. The outdoor unit of claim 2, wherein the water guide plate includes an upper member that serves as an upper portion including the slope and comprises synthetic resin and a lower member that serves as a lower portion and is formed of a rubber sheet.

5. The outdoor unit of claim 1, wherein the bottom plate includes a raised part formed by upwardly bending an outer peripheral part of the bottom plate, and wherein the water guide plate is positioned such that a lower end of the water guide plate is in proximity to the raised part of the bottom plate.

6. The outdoor unit of claim 1, wherein the water guide plate comprise synthetic resin or rubber.

7. An outdoor unit for an air-conditioning apparatus, the outdoor unit comprising:

a casing;

a heat exchanger disposed in an upper part of an inner space of the casing;

a bottom plate located at a bottom of the casing, the bottom plate having a drain hole through which drain water that is generated on the heat exchanger is discharged outside;

a support disposed in the inner space of the casing, the support supporting the heat exchanger in the upper part of the inner space of the casing;

a drain structure disposed under the heat exchanger, the drain structure guiding the drain water to the bottom plate; and a side panel covering an outer side surface of the casing, wherein the drain structure includes a first water guide pipe disposed along a lower end face of the heat exchanger in the casing, the first water guide pipe having an opening facing the lower end face of the heat exchanger, and a second water guide pipe connected to the first water guide pipe, the second water guide pipe guiding the drain water to the bottom plate, wherein the first water guide pipe and the second water guide pipe define a drain path and wherein the side panel includes a hook in an upper end part of the side panel and the hook catches an edge of the opening of the first water guide pipe.

8. The outdoor unit of claim 7, wherein the opening of the first water guide pipe has an inner edge located adjacent to the inner space of the casing and an outer edge located adjacent to an outside of the casing, the inner edge is positioned above the lower end face of the heat exchanger, and the outer edge is positioned below the lower end face of the heat exchanger.

9. The outdoor unit of any one of claim 7, wherein the bottom plate includes a raised part formed by upwardly bending an outer peripheral part of the bottom plate, and wherein the second water guide pipe is positioned such that a lower end of the second water guide pipe is in proximity to the raised part of the bottom plate.

10. The outdoor unit of claim 7, wherein the first and second water guide pipes comprise synthetic resin or rubber.

* * * * *